US008348701B1

(12) United States Patent
Lan et al.

(10) Patent No.: US 8,348,701 B1
(45) Date of Patent: Jan. 8, 2013

(54) CABLE CONNECTOR ASSEMBLY

(75) Inventors: Rong-Qin Lan, New Taipei (TW); Li-Jun Xu, New Taipei (TW); Ming-Han Lin, New Taipei (TW)

(73) Assignee: Cheng Uei Precision Industry Co., Ltd., New Taipei (TW)

( * ) Notice: Subject to any disclaimer, the term of this patent is extended or adjusted under 35 U.S.C. 154(b) by 0 days.

(21) Appl. No.: 13/287,192

(22) Filed: Nov. 2, 2011

(51) Int. Cl.
*H01R 13/648* (2006.01)

(52) U.S. Cl. ..... 439/607.19

(58) Field of Classification Search ..... 439/607.19, 439/607.17
See application file for complete search history.

(56) References Cited

U.S. PATENT DOCUMENTS 6,036,544 A * 3/2000 Brunker et al. ..... 439/607.01
6,659,799 B2 * 12/2003 Yang ..... 439/607.19
7,059,908 B2 * 6/2006 Yamaguchi ..... 439/607.17
7,114,981 B1 * 10/2006 Huang et al. ..... 439/353
2006/0040557 A1 * 2/2006 Yamaguchi ..... 439/607
2008/0188129 A1 * 8/2008 Moritake et al. ..... 439/609
2009/0011646 A1 * 1/2009 Yamaji et al. ..... 439/609
2010/0093215 A1 * 4/2010 Xiong et al. ..... 439/607.19

* cited by examiner

*Primary Examiner* — Gary F. Paumen
(74) *Attorney, Agent, or Firm* — WPAT, P.C.; Anthony King

(57) ABSTRACT

A cable connector assembly connecting between a cable and a printed circuit board includes a plug connector and a receptacle connector. The plug connector includes a plug housing, a plurality of plug terminals received in the plug housing, and a plug shielding shell surrounding the plug housing. A plurality of contact strips extend downward from a periphery of the plug shielding shell to be attached to a periphery of the plug housing. The receptacle connector includes a receptacle housing, a plurality of receptacle terminals received in the receptacle housing, and a receptacle shielding shell surrounding the receptacle housing. A plurality of elastic strips is bent inward and then downward from a periphery of the receptacle shielding shell. The plug connector is engaged with the receptacle connector with the plug terminals contacting with the receptacle terminals and the contact strips contacting with the elastic strips.

9 Claims, 4 Drawing Sheets

CABLE CONNECTOR ASSEMBLY

BACKGROUND OF THE INVENTION

1. Field of the Invention

The present invention generally relates to a cable connector assembly, and more particularly to a cable connector assembly with electromagnetic shielding function.

2. The Related Art

Conventionally, a cable connector assembly includes a plug connector and a receptacle connector. The plug connector includes a plug housing, and a plurality of plug terminals received in the plug housing. A top end of each of the plug terminals is connected with a cable. The receptacle connector includes a receptacle housing, and a plurality of receptacle terminals received in the receptacle housing. A bottom end of each of the receptacle terminals is soldered on a printed circuit board. Then the plug connector is engaged with the receptacle connector with the plug terminals contacting with the receptacle terminals to realize an electrical connection between the cable and the printed circuit board. However, an electromagnetic interference is often apt to happen in the cable connector assembly on account of the cable connector assembly having no electromagnetic shielding function that further affects the electrical connection between the cable and the printed circuit board.

SUMMARY OF THE INVENTION

An object of the present invention is to provide a cable connector assembly which includes a plug connector adapted for connecting with a cable, and a receptacle connector adapted for being soldered on a printed circuit board and engaged with the plug connector. The plug connector includes a plug housing, a plurality of plug terminals and a plug shielding shell. The plug housing has a base portion and a tongue portion protruded downward from a bottom of the base portion. The tongue portion defines an inserting groove extending vertically to penetrate through a bottom of the tongue portion. The plug housing defines two rows of plug terminal grooves of which each has a top thereof penetrating through the base portion and a bottom thereof penetrating through a corresponding side wall of the inserting groove. The plug terminal is received in the plug terminal groove with a top end thereof being fastened in the top of the plug terminal groove and connected with the cable, and a bottom end thereof being exposed out from the corresponding side wall. The plug shielding shell surrounds the base portion of the plug housing. A plurality of contact strips extends downward from a periphery bottom of the plug shielding shell to be attached to periphery outsides of the plug housing. The receptacle connector includes a receptacle housing, a plurality of receptacle terminals and a receptacle shielding shell. The receptacle housing has a bottom wall, two side walls and two end walls which are interconnected to define a receiving space thereamong for receiving the tongue portion therein. An inserting portion is protruded upward from a top of the bottom wall and inserted into the inserting groove. The receptacle housing defines two rows of receptacle terminal grooves of which each has one side thereof passing through an inner surface of the side wall and the bottom wall, and the other side thereof passing through a side surface of the inserting portion facing the side wall and the bottom wall. The receptacle terminals are received in the receptacle terminal grooves and each receptacle terminal has a soldering portion projected out of the receptacle housing to be soldered on the printed circuit board. One end of the soldering portion defines two contact portions spaced from each other to be respectively inserted into the two sides of the receptacle terminal groove to contact with the bottom ends of the plug terminals. The receptacle shielding shell surrounds the receptacle housing. A plurality of elastic strips is bent inward and then downward from a periphery top of the receptacle shielding shell to project into the receiving space to contact with the contact strips. At least two soldering plates extend outward from a periphery bottom of the receptacle shielding shell to be soldered on the printed circuit board.

As described above, the contact strips of the plug shielding shell contact with the elastic strips of the receptacle shielding shell to make the plug shielding shell effectively connect with the receptacle shielding shell. Thus, a better electromagnetic shielding effectiveness is acquired to achieve a steady signal transmission between the cable and the printed circuit board.

BRIEF DESCRIPTION OF THE DRAWINGS

The present invention will be apparent to those skilled in the art by reading the following description, with reference to the attached drawings, in which.

DETAILED DESCRIPTION OF THE PREFERRED EMBODIMENT

Figure 1:
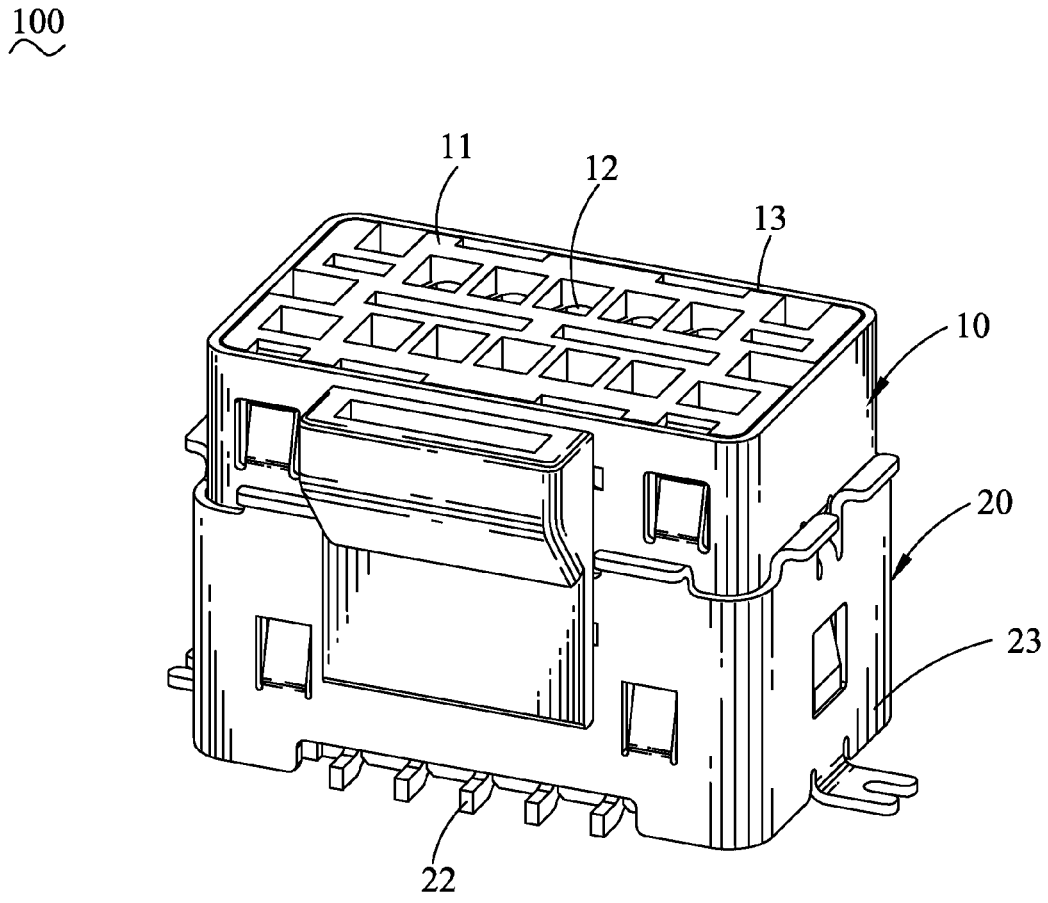
FIG. 1 is a perspective view of a cable connector assembly in accordance to the present invention, wherein the cable connector assembly includes a plug connector and a receptacle connector which are engaged with each other.
Figure 2:
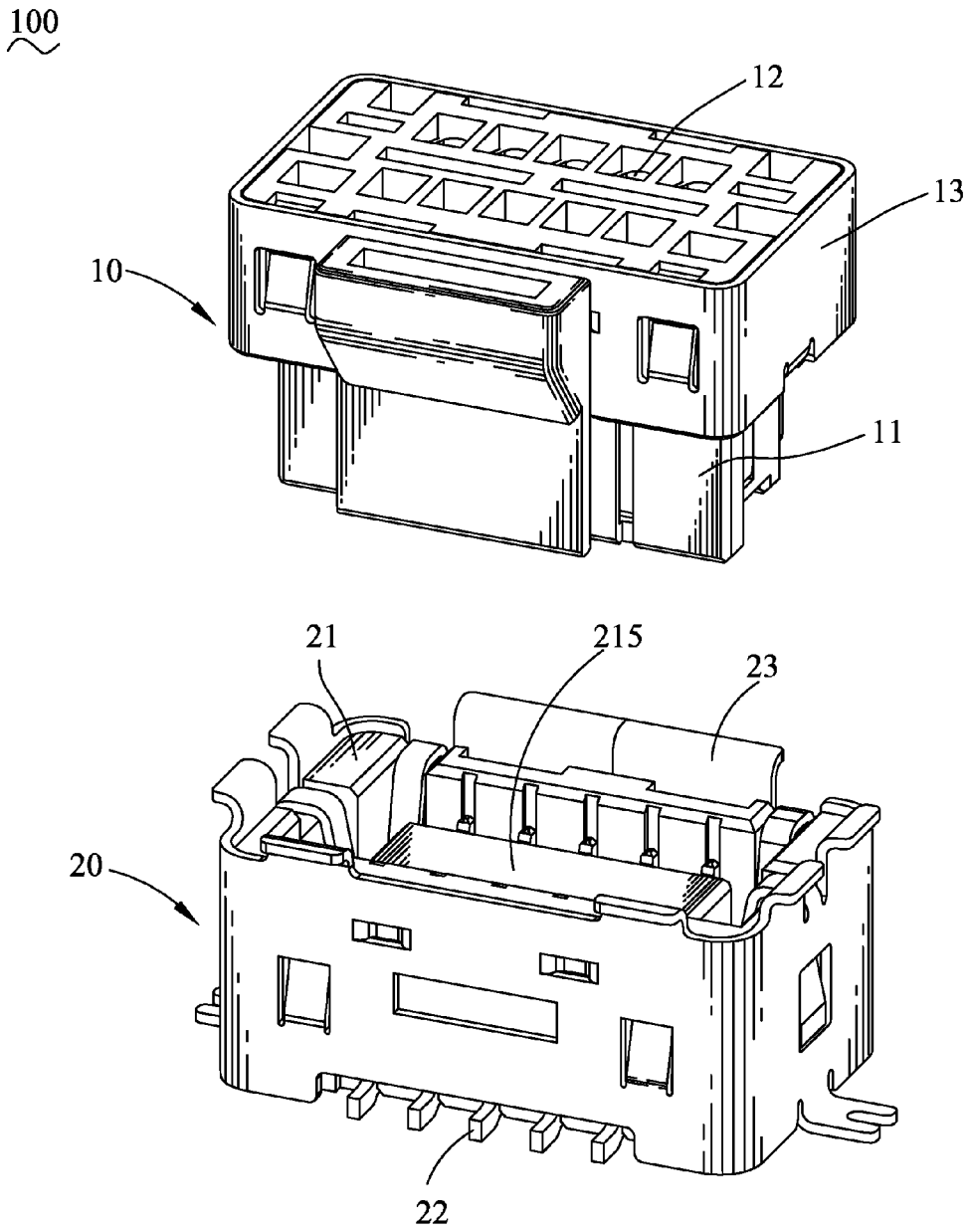
FIG. 2 is a partially exploded view of the cable connector assembly of FIG. 1, wherein the plug connector is parted from the receptacle connector.
Figure 3:
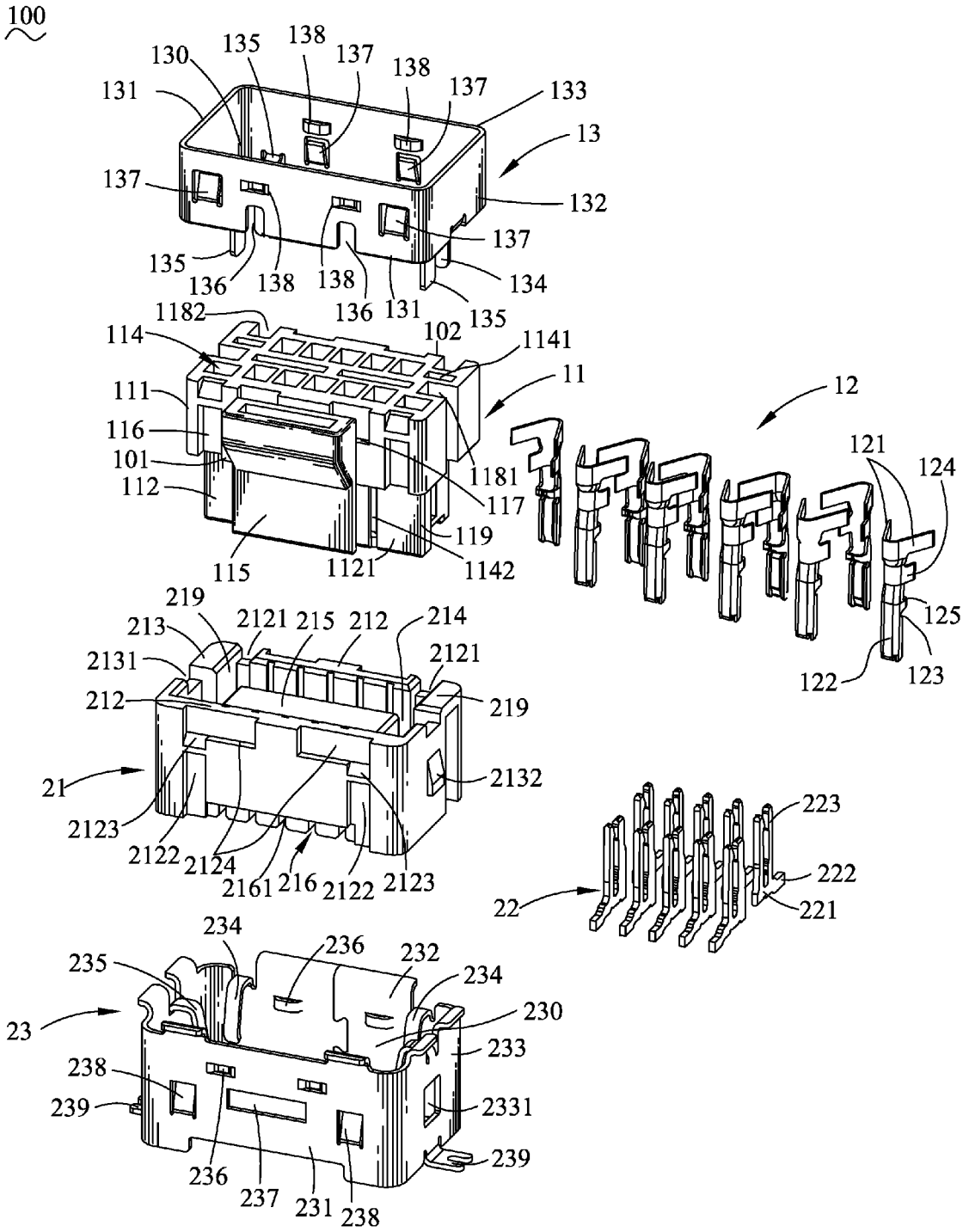
FIG. 3 is an exploded view of the cable connector assembly of FIG. 1.

With reference to FIG. 1, FIG. 2 and FIG. 3, a cable connector assembly 100 in accordance with the present invention is shown. The cable connector assembly 100 adapted for connecting between a cable (not shown) and a printed circuit board (not shown) includes a plug connector 10 and a receptacle connector 20.

Referring to FIG. 1, FIG. 2, FIG. 3 and FIG. 5, the plug connector 10 includes a plug housing 11, a plurality of plug terminals 12 and a plug shielding shell 13. The plug housing 11 has a base portion 111 and a tongue portion 112 of a substantially rectangular hollow shape protruded downward from a middle of a bottom face of the base portion 111. Accordingly, an inserting groove 113 is formed in a middle of the tongue portion 112 and has a bottom opened freely. Two opposite ends of a front wall 1121 of the tongue portion 112 extend oppositely to form two extending walls 119 to make the front wall 1121 of the tongue portion 112 wider than a rear wall 1122 of the tongue portion 112. The plug housing 11 defines two rows of plug terminal grooves 114. Each row of the plug terminal grooves 114 are arranged at regular intervals along a transverse direction of the plug housing 11.

Each plug terminal groove 114 includes a rectangular receiving groove 1141 extending vertically to penetrate through a top of the base portion 111, a fastening groove 1142 extending vertically into the corresponding front wall 1121 or the rear wall 1122 of the tongue portion 112 from an outer end of a bottom of the receiving groove 1141, with a middle thereof longitudinally penetrating through the front wall 1121 or the rear wall 1122, and a U-shaped holding groove 1143 extending vertically to penetrate through a bottom of the base portion 111, and connecting with the bottom of the receiving groove 1141 and the fastening groove 1142. A fastening board 115 is located in front of the plug housing 11 and has two resisting pillars 1152 protruded towards the base portion 111 from a middle of a rear face of the fastening board 15 and connected with a front surface 101 of the base portion 111. A middle of a lower portion of the rear face of the fastening board 115 protrudes towards the tongue portion 112 to define a rib 1151 spaced from the tongue portion 112. The front surface 101 and a rear surface 102 of the base portion 111 respectively define two first buckling grooves 116 and two first recesses 117 spaced from one another. The plug housing 11 defines two first passages 1181 vertically passing through two middles of two opposite sides of the plug housing 11, and two second passages 1182 extending vertically to pass through two opposite ends of a back of the plug housing 11.

Referring to FIG. 3, each of the plug terminals 12 has two first fastening arms 121 connected with each other to show a V shape from a top view. A bottom of a junction of the two fastening arms 121 extends downward to form a first contact arm 122. A middle of a bottom of the first contact arm 122 is folded up towards the first contact arm 122 to form a second contact arm 123. Two second fastening arms 124 are inclined oppositely from two sides of the first contact arm 122, and located under the two first fastening arms 121. Two middles of the two sides of the first contact arm 122 are bent towards each other to form two third fastening arms 125 located above the second contact arm 123 and under the two second fastening arms 124.

With reference to FIG. 1, FIG. 2 and FIG. 3, the plug shielding shell 13 is looped from a metal plate and has a front plug plate 131, two end plug plates 132 and a rear plug plate 133 to together surround a plug accommodating space 130 thereamong. Two portions of a bottom of the rear plug plate 133 are bent inward and then extend downward to form two first contact strips 134. Two middles of two bottoms of the two end plug plates 132 are bent towards each other and then extend downward to form two second contact strips 135. Two lower portions of the front plug plate 131 define two notches 136 penetrating through a bottom of the front plug plate 131 and spaced from each other. Two ends of the front plug plate 131 and two ends of the rear plug plate 133 are respectively punched inward to form two first buckling pieces 137 spaced from each other. The front plug plate 131 and the rear plug plate 133 respectively define two convex first blocking portions 138 projected into the plug accommodating space 130.

Referring to FIG. 1, FIG. 2, FIG. 3 and FIG. 5, when the plug connector 10 is assembled, the plug terminals 12 are received in the plug terminal grooves 114 with the first fastening arms 121 being received in the receiving grooves 1141, the second fastening arms 124 being received in the holding grooves 1143, and the third fastening arms 125 being positioned on the bottom of the base portion 111. The first contact arms 122 and the second contact arms 123 are fastened in the fastening grooves 1142 with middles of the first and second contact arms 122, 123 being exposed from the middles of the fastening grooves 1142. The cable is fastened in the first fastening arms 121, the second fastening arms 124, and the third fastening arms 125 to connect with the plug terminals 12 of the plug connector 10. The base portion 111 is inserted into the plug accommodating space 130 of the plug shielding shell 13 with the second contact strips 135 being received in the first passages 1181, the first contact strips 134 being received in the second passages 1182, the first blocking portions 138 being blocked in the first recesses 117, the first buckling portions 137 being buckled in the first buckling grooves 116, and the resisting pillars 1152 being clipped in the notches 136.

With reference to FIGS. 1-4, the receptacle connector 20 includes a receptacle housing 21, a plurality of receptacle terminals 22 and a receptacle shielding shell 23. The receptacle housing 21 has a bottom wall 211, two side walls 212 extending upward from a front and a rear sides of the bottom wall 211, and two end walls 213 extending upward from two opposite ends of the bottom wall 211. A receiving space 214 is formed among the bottom wall 211, the two side walls 212 and the two end walls 213. Two rears of the two end walls 213 extend towards each other to form two blocking walls 219 to make a rear of the receiving space 214 narrower than a front of the receiving space 214. An inserting portion 215 is protruded upward from a middle of a top of the bottom wall 211. The receptacle housing 21 defines two rows of receptacle terminal grooves 216. Each row of the receptacle terminal grooves 216 are arranged at regular intervals along a transverse direction of the receptacle housing 21.

Each receptacle terminal groove 216 includes a clipping slot 2161 penetrating through a bottom of the bottom wall 211 and a bottom of the corresponding side wall 212, an L-shaped first fixing slot 2162 vertically passing through an inner surface of the side wall 212 and the bottom wall 211, and an L-shaped second fixing slot 2163 vertically passing through a side surface of the inserting portion 215 facing the side wall 212, and the bottom wall 211. The second fixing slot 2163 is symmetrical to the first fixing slot 2162. Two ends of a top of the side wall 212 at the rear side of the receptacle housing 21 are concaved downward to form two first gaps 2121. Two middles of two tops of the two end walls 213 are concaved downward to form two second gaps 2131. Two upper portions of each side wall 212 are concaved inward to form two second recesses 2124. Two lower portions of the side wall 212 at the front side of the receptacle housing 21 are concaved inward to form two second buckling grooves 2122. An outer end of a bottom wall of each recess 2124 is inclined downward to define a guiding surface 2123 located above the second buckling groove 2122. Two portions of the two end walls 213 protrude oppositely to form two locating blocks 2132.

Referring to FIG. 3, each of the receptacle terminals 22 has a soldering portion 221 disposed levelly. Two portions of one end of the soldering portion 221 protrude upward to define a first contact portion 222 and a second contact portion 223 spaced from each other.

Referring to FIG. 3, the receptacle shielding shell 23 has a front receptacle plate 231, a rear receptacle plate 232 and two end receptacle plates 233 which are interconnected with each other to form a receptacle accommodating space 230 thereamong. Two ends of a top of the rear receptacle plate 232 are bent inward, and then extend downward to form two first elastic strips 234. Two middles of two tops of the two end receptacle plates 233 are bent inward and then extend downward to form two second elastic strips 235. The front receptacle plate 231 and the rear receptacle plate 232 respectively define two convex second blocking portions 236 projected into the receptacle accommodating space 230 and transversely spaced from each other. A middle of the front receptacle plate 231 defines an opening 237 located under an interval between the two second blocking portions 236. Two portions of the front receptacle plate 231 are punched inward to form two second buckling pieces 238 located at two ends of the opening 237. A middle of each end receptacle plate 233 defines a locating hole 2331. Two middles of two bottoms of the two end receptacle plates 233 are bent oppositely to form two soldering plates 239.

Figure 4:
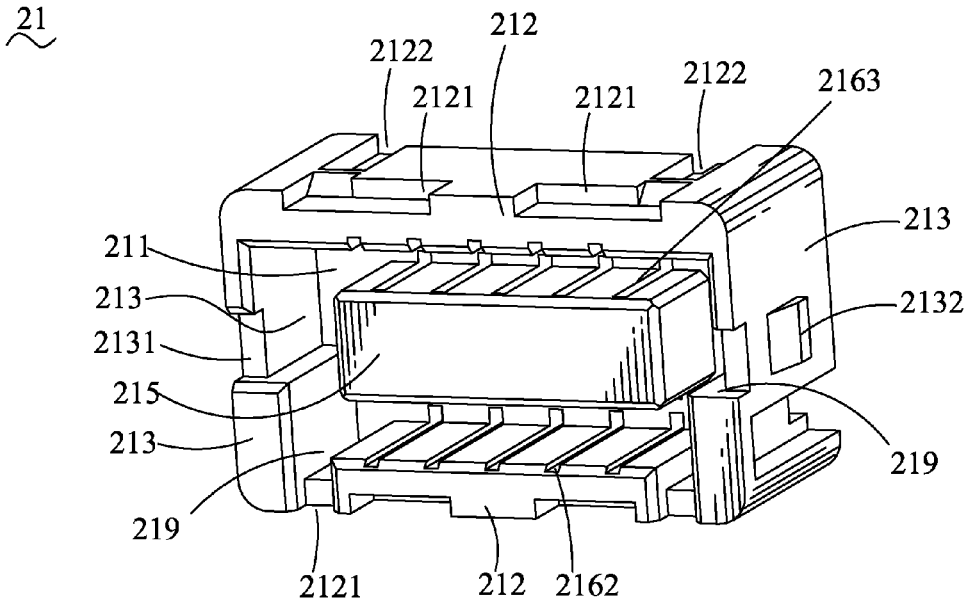
FIG. 4 is a perspective view of a receptacle housing of the receptacle connector of the cable connector assembly of FIG. 3.
Figure 5:
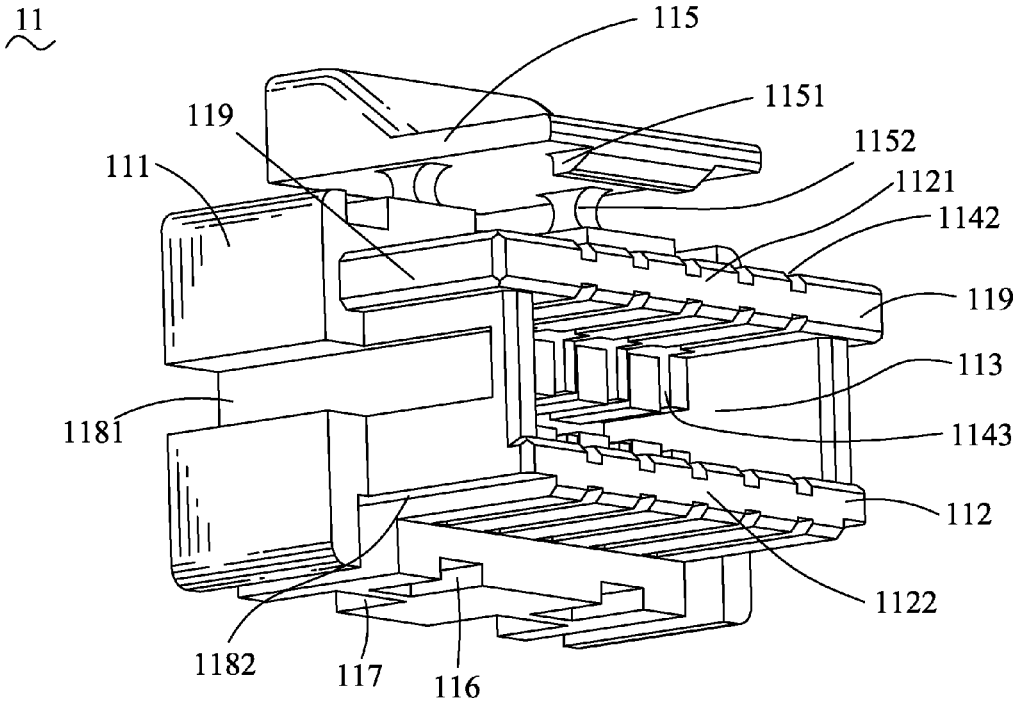
FIG. 5 is a perspective view of a plug housing of the plug connector of the cable connector assembly of FIG. 3.

Referring to FIG. 2, FIG. 3 and FIG. 4, when the receptacle connector 20 is assembled, the receptacle terminals 22 are received in the receptacle terminal grooves 216 with the first contact portions 222 and the second contact portions 223 being fixed in the first fixing slots 2162 and the second fixing slots 2163 and projecting into the receiving space 214. The soldering portions 221 of the receptacle terminals 22 are clipped in the clipping slots 2161 with free ends thereof being projected out of the receptacle housing 21 to be soldered on the printed circuit board. The receptacle housing 21 is inserted into the accommodating chamber 230 of the receptacle shielding shell 23 with the first elastic strips 234 and the second elastic strips 235 being fastened in the first gaps 2121 and the second gaps 2131 and further elastically projecting into the receiving space 214, the second blocking portions 236 being blocked in the second recesses 2124, the second buckling pieces 238 being buckled in the second buckling grooves 2122 along the guiding surfaces 2123, and the locating blocks 2132 being located in the locating holes 2331 to integrate the receptacle shielding shell 23 together with the receptacle housing 21 tightly. The soldering plates 239 are soldered on the printed circuit board.

Referring to FIGS. 1-5, in use, when the plug connector 10 is engaged with the receptacle connector 20, the tongue portion 112 is inserted into the receiving space 214 with the inserting portion 215 being inserted in the inserting groove 113 and resisting against the bottom of the base portion 111. Because the front wall 1121 of the tongue portion 112 is wider than the rear wall 1122 of the tongue portion 112, and the rear of the receiving space 214 is narrower than the front of the receiving space 214, a wrong operation can be avoided by virtue of the front wall 1121 of the tongue portion 112 being inserted into the front of the receiving space 214 and the rear wall 1122 of the tongue portion 112 being inserted into the rear of the receiving space 214. The rib 1151 of the fastening board 115 of the plug housing 11 is inserted into the opening 237 of the receptacle shielding shell 23. The first contact arms 122 contact with the first contact portions 222, and the second contact arms 123 contact with the second contact portions 223 to realize an electrical connection between the plug connector 10 and the receptacle connector 20 so as to electrically connect the cable with the printed circuit board. The second contact strips 135 contact with the second elastic strips 235, and the first contact strips 134 contact with the first elastic strips 234 to make the plug shielding shell 13 effectively connect with the receptacle shielding shell 23. Thus, a better electromagnetic shielding effectiveness is acquired to achieve a steady signal transmission between the cable and the printed circuit board.

As described above, the second contact strips 135 of the plug shielding shell 13 contact with the second elastic strips 235 of the receptacle shielding shell 23, and the first contact strips 134 of the plug shielding shell 13 contact with the first elastic strips 234 of the receptacle shielding shell 23 to make the plug shielding shell 13 effectively connect with the receptacle shielding shell 23. Thus, the better electromagnetic shielding effectiveness is acquired to achieve the steady signal transmission between the cable and the printed circuit board. The front wall 1121 of the tongue portion 112 has the two extending walls 119 at the two ends thereof to make the front wall 1121 wider than the rear wall 1122 of the tongue portion 112, and the two rears of the two end walls 213 have the two blocking walls 219 located in the rear of the receiving space 214 to make the rear of the receiving space 214 narrower than the front of the receiving space 214, so that can effectively ensure the front wall 1121 of the tongue portion 112 to be inserted into the front of the receiving space 214 and the rear wall 1122 of the tongue portion 112 to be inserted into the rear of the receiving space 214 for preventing the wrong operation.

What is claimed is:

1. A cable connector assembly, comprising:

a plug connector adapted for connecting with a cable, the plug connector including a plug housing having a base portion and a tongue portion protruded downward from a bottom of the base portion, the tongue portion defining an inserting groove extending vertically to penetrate through a bottom of the tongue portion, the plug housing defining two rows of plug terminal grooves of which each has a top thereof penetrating through the base portion and a bottom thereof penetrating through a corresponding side wall of the inserting groove, a plurality of plug terminals each received in the plug terminal groove with a top end thereof being fastened in the top of the plug terminal groove and connected with the cable, and a bottom end thereof being exposed out from the corresponding side wall, and a plug shielding shell surrounding the base portion of the plug housing, a plurality of contact strips extending downward from a periphery bottom of the plug shielding shell to be attached to periphery outsides of the plug housing; and a receptacle connector adapted for being soldered on a printed circuit board and engaged with the plug connector, the receptacle connector including a receptacle housing having a bottom wall, two side walls and two end walls which are interconnected to define a receiving space thereamong for receiving the tongue portion therein, an inserting portion being protruded upward from a top of the bottom wall and inserted into the inserting groove, the receptacle housing defining two rows of receptacle terminal grooves of which each has one side thereof passing through an inner surface of the side wall and the bottom wall, and the other side thereof passing through a side surface of the inserting portion facing the side wall and the bottom wall, a plurality of receptacle terminals received in the receptacle terminal grooves, each receptacle terminal having a soldering portion projected out of the receptacle housing to be soldered on the printed circuit board, one end of the soldering portion defining two contact portions spaced from each other to be respectively inserted into the two sides of the receptacle terminal groove to contact with the bottom ends of the plug terminals, and a receptacle shielding shell surrounding the receptacle housing, a plurality of elastic strips being bent inward and then extending downward from a periphery top of the receptacle shielding shell to project into the receiving space to contact with the contact strips, at least two soldering plates extending outward from a periphery bottom of the receptacle shielding shell to be soldered on the printed circuit board.

2. The cable connector assembly as claimed in claim 1, wherein two opposite ends of a front wall of the tongue portion extend oppositely to form two extending walls to make the front wall of the tongue portion wider than a rear wall of the tongue portion, two rears of the two end walls of the receptacle housing extend towards each other to form two blocking walls to make a rear of the receiving space narrower than a front of the receiving space so as to ensure the front wall of the tongue portion to be inserted into the front of the receiving space and the rear wall of the tongue portion to be inserted into the rear of the receiving space.

3. The cable connector assembly as claimed in claim 1, wherein the plug shielding shell has a front plug plate, two end plug plates and a rear plug plate interconnected with each other to define a plug accommodating space for receiving the base portion of the plug housing therein, the contact strips include two first contact strips and two second contact strips formed by being bent inward and then extending downward from two portions of a bottom of the rear plug plate and two bottoms of the two end plug plates respectively, the receptacle shielding shell has a front receptacle plate, a rear receptacle plate and two end receptacle plates interconnected with each other to define a receptacle accommodating space for receiving the receptacle housing therein, the elastic strips include two first elastic strips and two second elastic strips formed by being bent inward and then extending downward from two ends of a top of the rear receptacle plate and two tops of the two end receptacle plates, so as to contact with the first contact strips and the second contact strips, respectively.

4. The cable connector assembly as claimed in claim 3, wherein the plug housing defines two first passages vertically passing through two opposite sides of the plug housing for receiving the second contact strips therein, and two second passages extending vertically to pass through two opposite ends of a back of the plug housing for receiving the first contact strips therein, a top of the side wall at a rear side of the receptacle housing are concaved downward to form two first gaps, two tops of the two end walls are concaved downward to form two second gaps, the first elastic strips and the second elastic strips are fastened in the first gaps and the second gaps and further elastically project into the receiving space to contact with the first contact strips and the second contact strips, respectively.

5. The cable connector assembly as claimed in claim 3, wherein the front plug plate and the rear plug plate respectively define two first buckling pieces and two convex first blocking portions spaced from one another, a front surface and a rear surface of the base portion respectively define two first buckling grooves for buckling the first buckling pieces therein, and two first recesses for blocking the first blocking portions therein.

6. The cable connector assembly as claimed in claim 3, further comprising a fastening board located in front of the plug housing, a rear surface of the fastening board defining two resisting pillars connected with the base portion, and a rib formed under the two resisting pillars and spaced from the tongue portion, a front plug plate of the plug shielding shell defining two notches penetrating through a bottom thereof for clipping the resisting pillars, the front receptacle plate of the receptacle shielding shell defining an opening for buckling the rib therein.

7. The cable connector assembly as claimed in claim 3, wherein the front receptacle plate and the rear receptacle plate respectively define two convex second blocking portions projected into the receptacle accommodating space, the front receptacle plate are further punched inward to form two second buckling pieces, two upper portions of each side wall of the receptacle housing define two second recesses for blocking the second blocking portions therein, two lower portions of the side wall at a front side of the receptacle housing define two second buckling grooves for buckling the second buckling pieces therein.

8. The cable connector assembly as claimed in claim 3, wherein each end receptacle plate of the receptacle shielding shell defines a locating hole, the two end walls of the receptacle housing protrude oppositely to form two locating blocks located in the locating holes.

9. The cable connector assembly as claimed in claim 3, wherein two bottoms of the two end receptacle plates are bent oppositely to form the two soldering plates soldered on the printed circuit board.

* * * * *